US010184198B2

(12) United States Patent
Lee

(10) Patent No.: US 10,184,198 B2
(45) Date of Patent: Jan. 22, 2019

(54) ROTARY LAUNDRY ROD STRUCTURE OF WASHING MACHINE

(71) Applicant: Meng-Lan Lee, Taipei (TW)

(72) Inventor: Meng-Lan Lee, Taipei (TW)

( * ) Notice: Subject to any disclaimer, the term of this patent is extended or adjusted under 35 U.S.C. 154(b) by 0 days.

(21) Appl. No.: 15/495,214

(22) Filed: Apr. 24, 2017

(65) Prior Publication Data

US 2017/0327987 A1 Nov. 16, 2017

(30) Foreign Application Priority Data

May 16, 2016 (TW) ..... 105115033 A

(51) Int. Cl.
*D06F 17/10* (2006.01)
*D06F 35/00* (2006.01)

(52) U.S. Cl.
CPC ..... *D06F 17/10* (2013.01)

(58) Field of Classification Search
CPC . D06F 1/04; D06F 11/00; D06F 13/00; D06F 13/02; D06F 15/00; D06F 17/06; D06F 17/10; D06F 23/04; D06F 37/14
See application file for complete search history.

(56) References Cited

U.S. PATENT DOCUMENTS 3,922,890 A * 12/1975 Shibata ..... D06F 37/14 68/23 R
5,651,278 A 7/1997 Pinkowski
6,145,350 A * 11/2000 Hwang ..... D06F 17/06 68/134

FOREIGN PATENT DOCUMENTS

| | | |
|---|---|---|
| TW | 269529 | 1/1996 |
| TW | 341243 U | 9/1998 |
| TW | M472073 U | 2/2014 |
| TW | M529013 U | 9/2016 |

* cited by examiner

*Primary Examiner* — David G Cormier
(74) *Attorney, Agent, or Firm* — Winston Hsu

(57) ABSTRACT

A rotary laundry rod structure of a washing machine includes a main body and a connecting member. The surface of the main body is provided with a plurality of protrusions. The protrusions each have a resistant surface for resisting water in the washing machine. The connecting member has a pivot portion pivotally connected to an inner tank of the washing machine. The connecting member is fixedly connected to the main body. When the resistant surface of the main body is lashed by the water, the connecting member is turned relative to the inner tank of the washing machine to cause rotary turbulence so as to enhance the washing effect.

7 Claims, 8 Drawing Sheets

ROTARY LAUNDRY ROD STRUCTURE OF WASHING MACHINE

FIELD OF THE INVENTION

The present invention relates to a laundry appliance, and more particularly to an auxiliary laundry appliance to enhance turbulence of the water in the washing machine.

BACKGROUND OF THE INVENTION

It is an important task to clean clothes since people have learned to make clothes with cloth, silk or modern man-made fibers. A washing machine is a machine that uses water to wash clothing and sheets. Laundry detergent is frequently used to clean clothes. The clothes are stirred and lashed by the water in the tank to remove the dirt. In modern automation machinery and technology, a washing machine becomes one of the essential electrical appliances in every household. Taiwan Patent Publication No. 341243 discloses a washing machine. The inner tank of the washing machine is provided with a high guide water channel and a low guide water channel. By the height difference between the two, the discharged water flow can fully stir the clothes in the tank of the washing machine to improve the cleaning effect. However, this technique is aimed at the design of the overall structure of the washing machine, and the cost of the washing machine is too high and not cost-effective.

Another technique for improving the cleaning effect is to provide a laundry rod in the tank of the washing machine. A laundry rod, as disclosed in Taiwan Design Publication No. 269529, has a columnar base with a plurality of fins. The columnar base is connected to the motor of the washing machine and can be driven by the motor to rotate, thereby causing turbulent flow to improve the cleaning effect. However, the laundry rod must be driven by electricity through the motor, which consumes additional energy.

Accordingly, the inventor of the present invention has devoted himself based on his many years of practical experiences to solve these problems.

SUMMARY OF THE INVENTION

The primary object of the present invention is to provide a rotary laundry rod structure of a washing machine. The surface of a main body is provided with uneven resistant surfaces for resisting water in the washing machine. When the resistant surfaces of the main body are lashed by the water, the connecting member is turned relative to the inner tank of the washing machine to cause rotary turbulence so as to enhance the washing effect.

In order to achieve the aforesaid object, the rotary laundry rod structure of a washing machine comprises a main body and a connecting member. The surface of the main body is provided with a plurality of protrusions. The protrusions each have a resistant surface for resisting water in the washing machine. The connecting member has a pivot portion pivotally connected to an inner tank of the washing machine. The connecting member is fixedly connected to the main body. When the resistant surface of the main body is lashed by the water, the connecting member is turned relative to the inner tank of the washing machine.

Preferably, each of the protrusions is a spiral raised stripe.

Preferably, each of the protrusions is a plate-like blade.

Preferably, the connecting member is integrally formed with the main body.

Preferably, the pivot portion includes a bearing.

Preferably, the connecting member has a first end and an opposing second end. The main body is disposed at the first end. The second end is provided with a brush.

Preferably, the connecting member is provided with an auxiliary fixing segment adjacent to the pivot portion and an auxiliary fixing member corresponding to the auxiliary fixing segment. The auxiliary fixing member is a hollow ring fitted on the connecting member to engage with or disengage from the auxiliary fixing segment.

Preferably, the auxiliary fixing segment is located in the inner tank.

DESCRIPTION OF THE PREFERRED EMBODIMENTS

Figure 1:
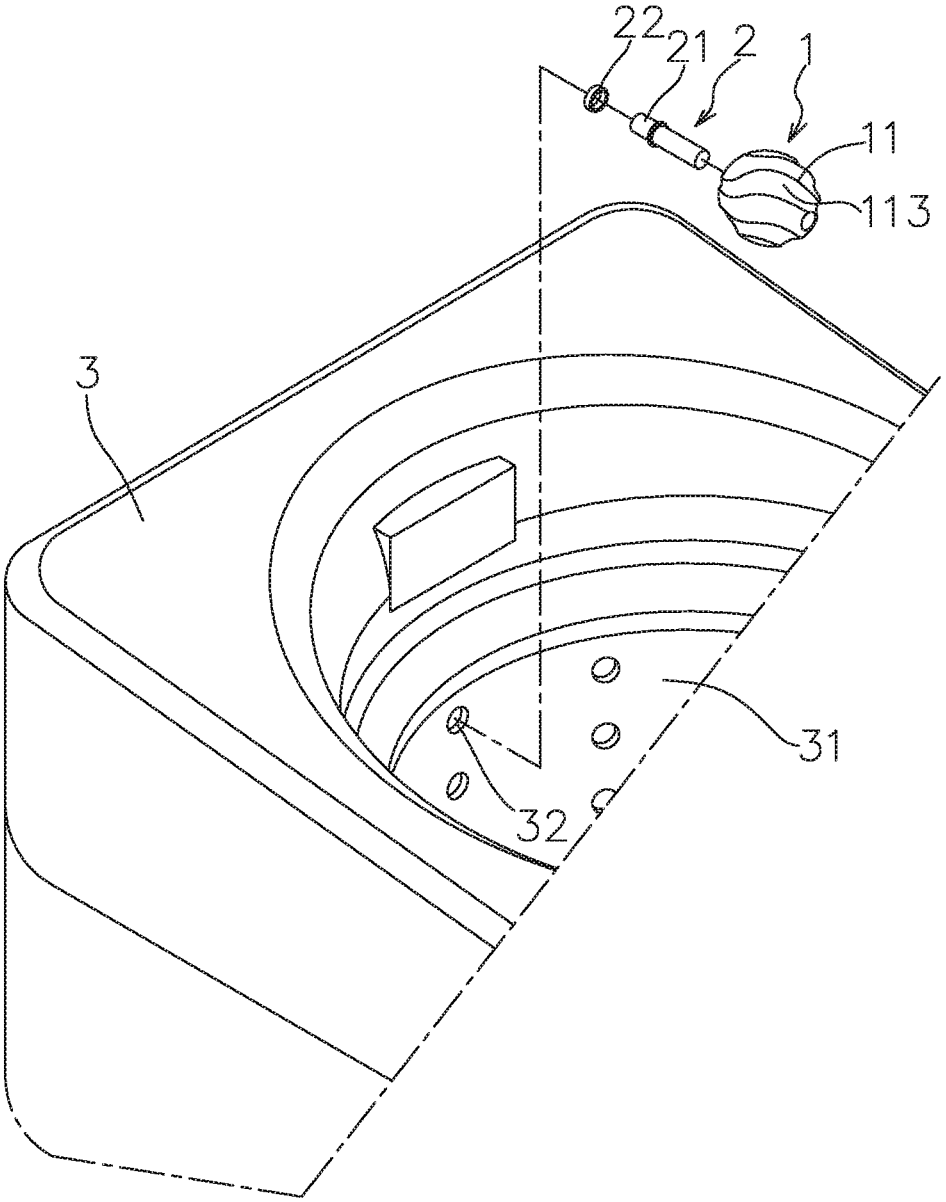
FIG. 1 is an exploded schematic view in accordance with a first embodiment of the present invention.

Advantages and features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. In the drawings, the relative sizes of elements should not be construed as being limited to the proportion and arrangement relationship as shown in the drawings and may be exaggerated for clarity, without departing from the spirit and scope of the present invention.

Figure 2:
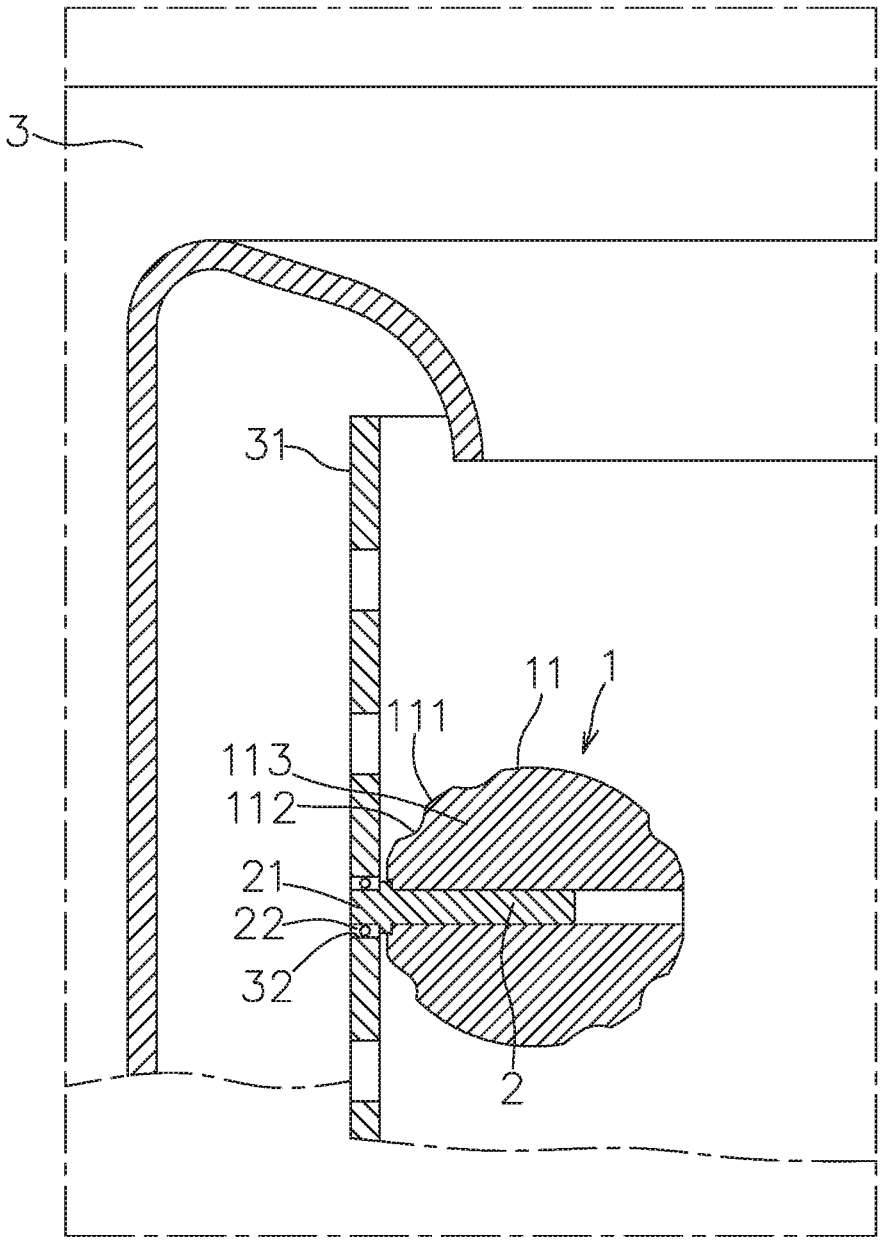
FIG. 2 is a sectional schematic view in accordance with the first embodiment of the present invention mounted to the inner tank of the washing machine.

FIG. 1 and FIG. 2 illustrate a first embodiment of the present invention. The present invention discloses a rotary laundry rod structure 20 of a washing machine. The rotary laundry rod structure 20 comprises a main body 1 and a connecting member 2. The shape of the main body 1 is not limited, and the surface of the main body 1 is provided with a plurality of protrusions. Each of the protrusions has a resistant surface 113 for resisting the water in the washing machine. In this embodiment, the main body 1 has a spherical shape. Each protrusion is a raised stripe 11 disposed on the main body 1. The raised stripe 11 is formed in a spiral shape. The raised stripe 11 has a relatively high peak 111 and a relatively low valley 112, and the resistant surface 113 is defined between the peak 111 and the valley 112.

On the other hand, the connecting member 2 is fixedly connected to the main body 1. In another embodiment, the connecting member 2 is integrally formed with the main body 1. The connecting member 2 has a pivot portion 21 which is pivotally connected to an inner tank 31 of a washing machine 3. As shown in FIG. 1, the pivot portion 21 is disposed at one end of the connecting member 2. In this embodiment, the pivot portion 21 includes a bearing 22. Through the bearing 22, the pivot portion 21 of the connecting member 2 is mounted to a perforation 32 of the inner tank 31 (as shown in FIG. 2). Thereby, the main body 1 is coupled to the inner tank 31 of the washing machine 3 through the connecting member 2 and is rotatable through the bearing 22.

Figure 3:
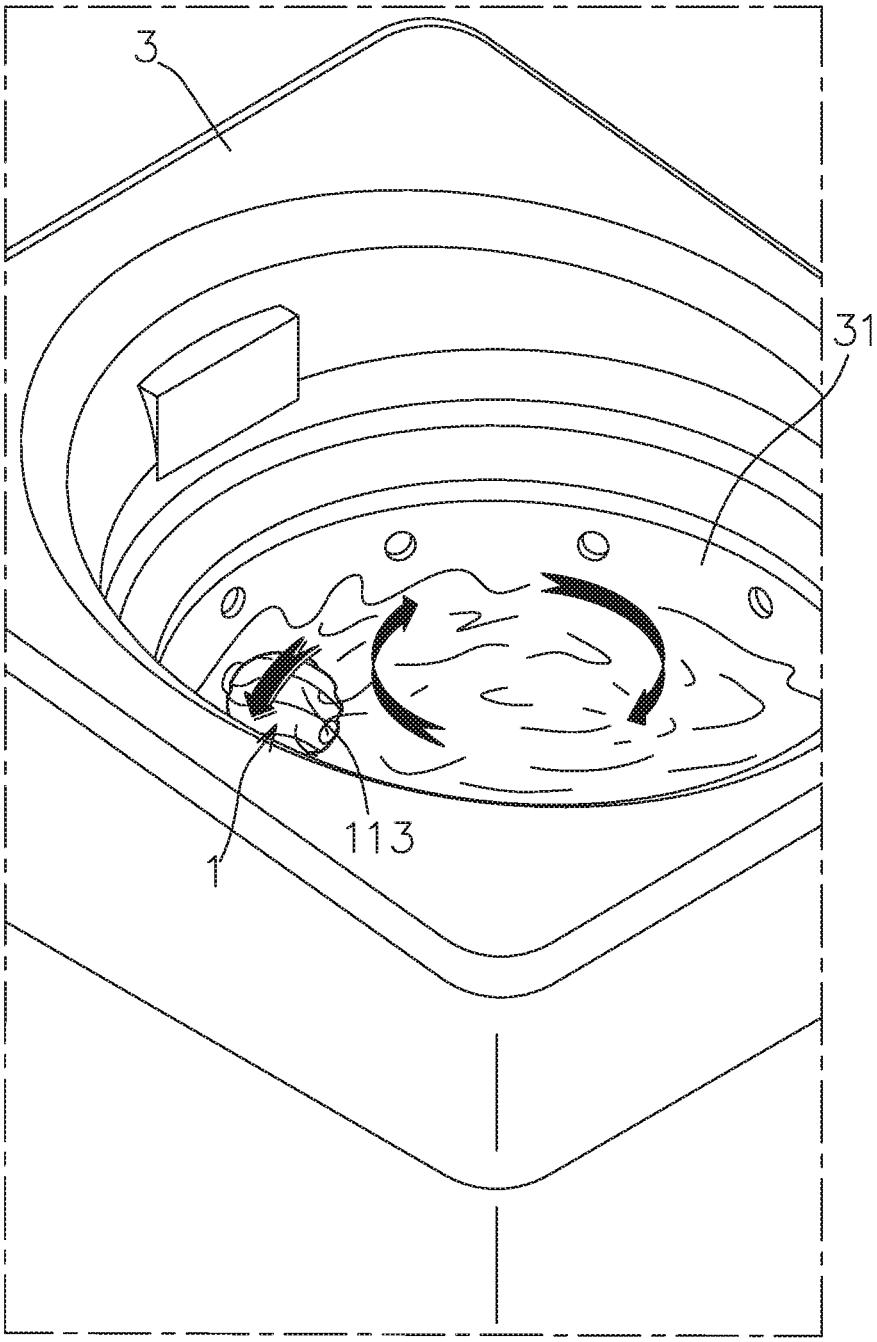
FIG. 3 is a schematic view in accordance with the first embodiment of the present invention in a use state.

The present invention is used as shown in FIG. 3. When the washing machine 3 is actuated, the inner tank 31 is first filled with water, the main body 1 is immersed in water, and the water in the inner tank 31 is agitated to form rotary water by the motor (not shown) of the washing machine 3. Because the surface of the main body 1 is formed with the resistant surfaces 113, the main body 1 is rotated when the water flows through the main body 1 to lash the resistant surfaces 113. Then, the rotating main body 1 further stirs the water with the resistant surfaces 113, causing the water to produce more and more intense turbulence. Accordingly, the aforesaid turbulence rubs against the clothes back and forth, achieving a better cleaning effect.

Figure 4:
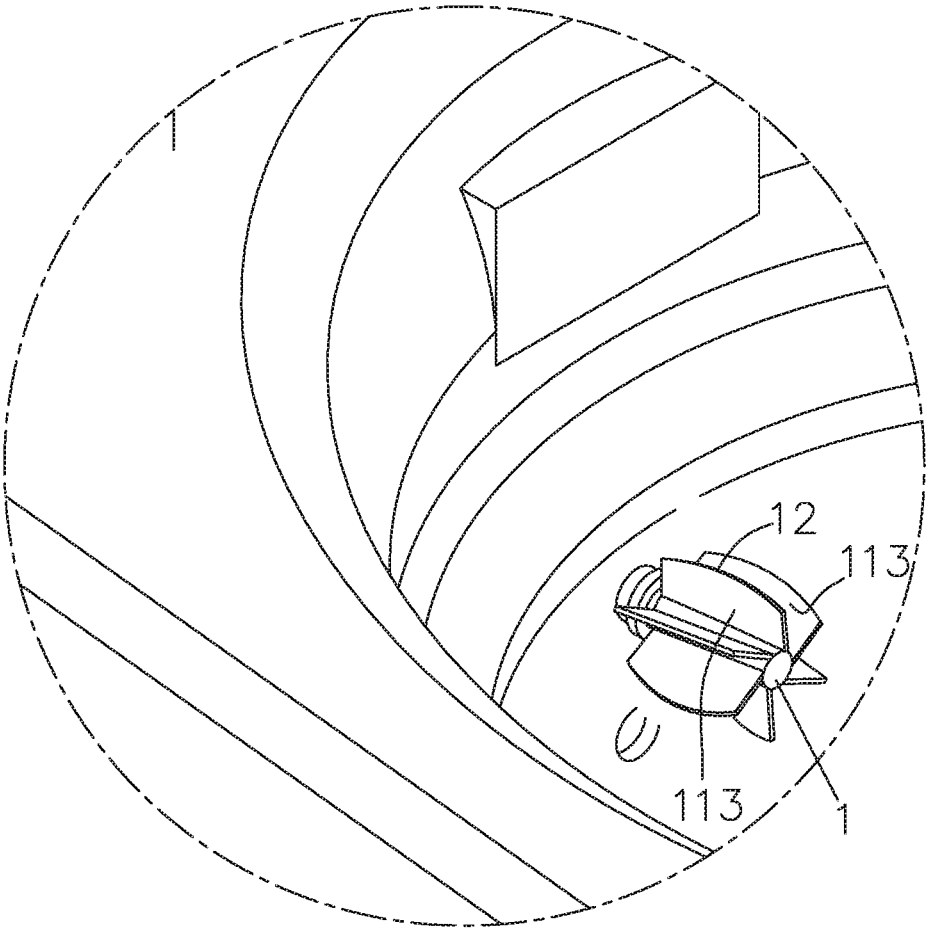
FIG. 4 is a perspective schematic view in accordance with a second embodiment of the present invention.

FIG. 4 illustrates a second embodiment of the present invention. The second embodiment is based on the first embodiment to modify the protrusions. In the second embodiment, the main body 1 is in the form of a straight rod, and each of the protrusions is a plate-like blade 12. The blades 12 are spaced apart on the circumferential side of the main body 1 and extend radially outwardly. Both sides of each blade 12 are formed with the resistant surfaces. The water lashes the blades 12 to turn the main body 1. The main body 1 stirs the water with the resistant surfaces 113, causing the water to produce more and more intense turbulence, enhancing the cleaning effect.

Figure 5:
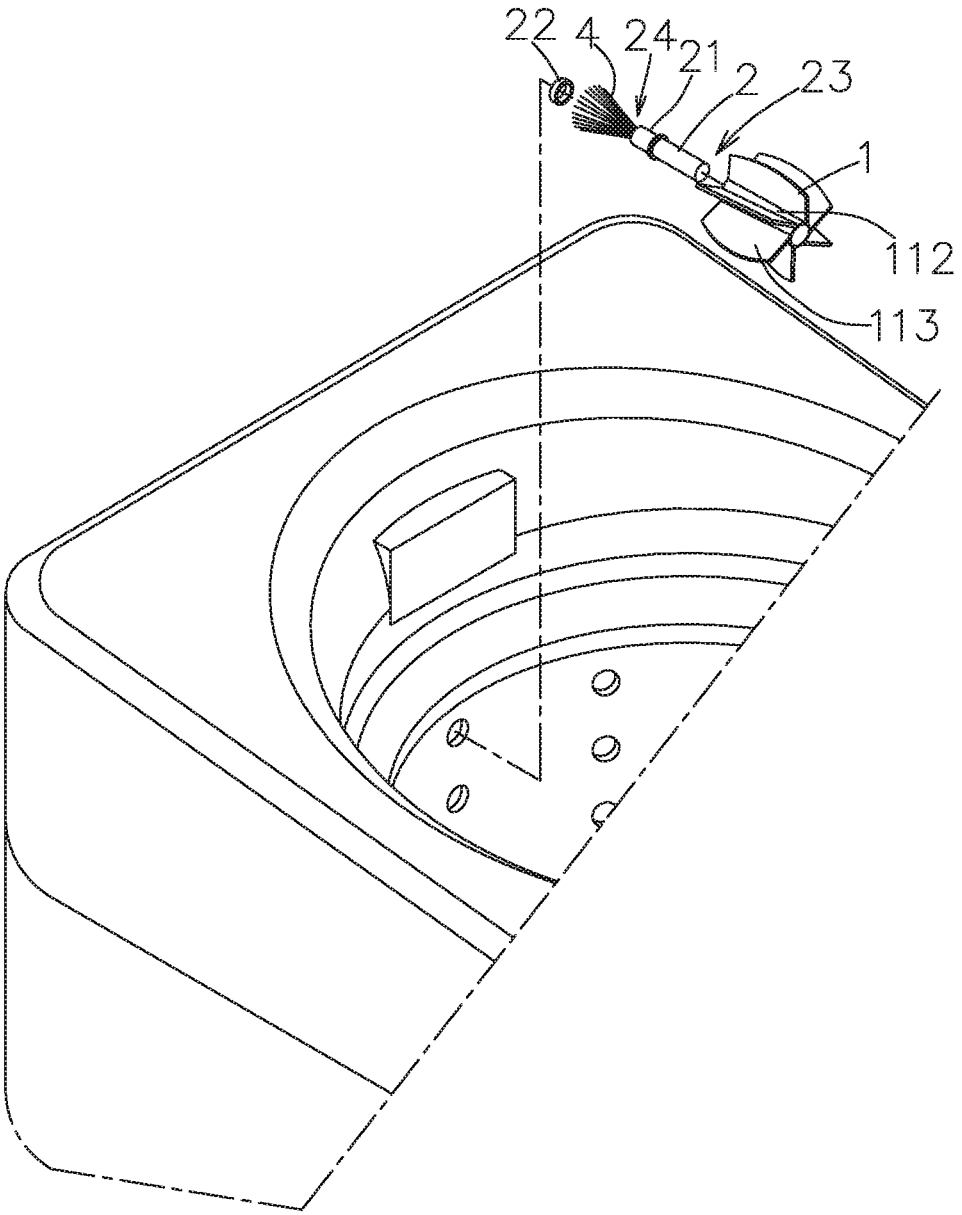
FIG. 5 is an exploded schematic view in accordance with a third embodiment of the present invention.
Figure 6:
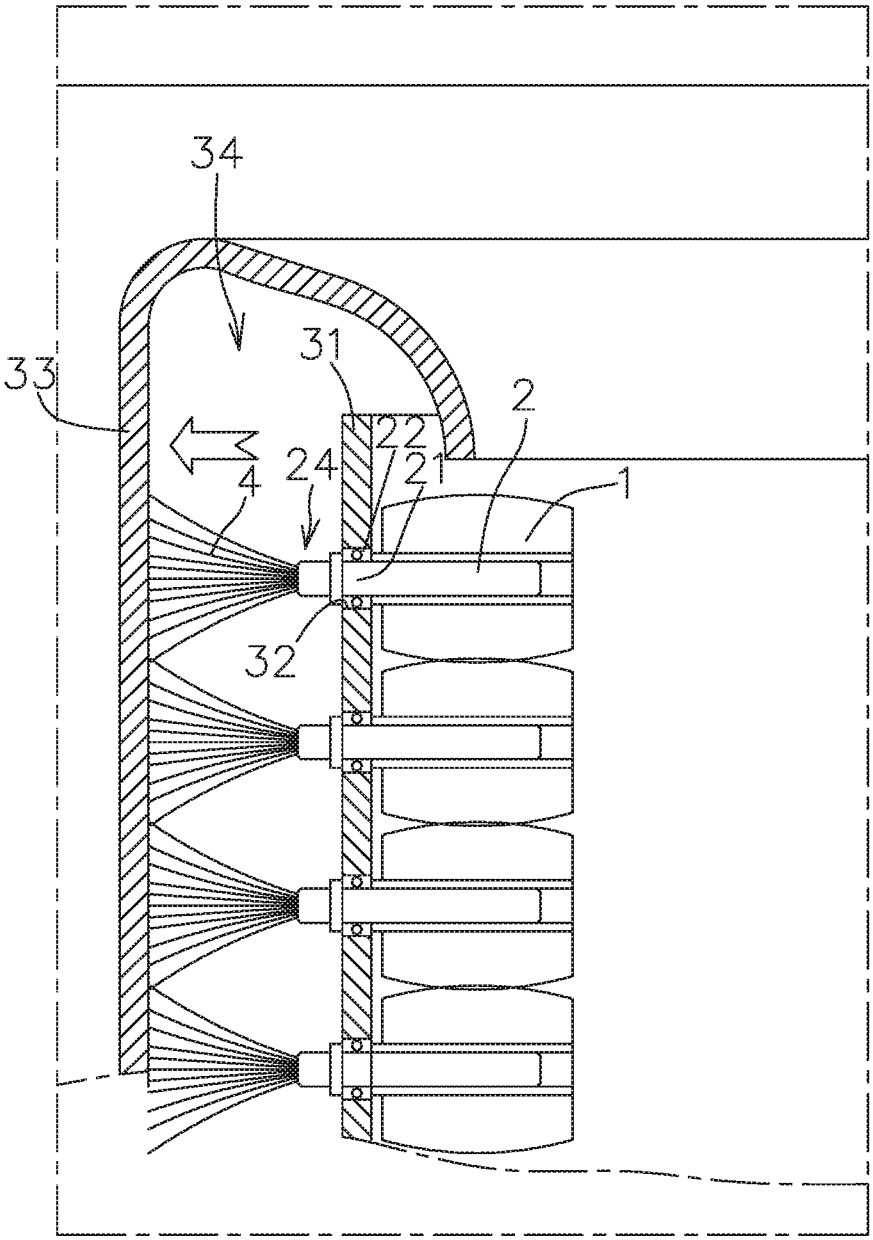
FIG. 6 is a sectional schematic view in accordance with the third embodiment of the present invention mounted to the inner tank of the washing machine.

FIG. 5 and FIG. 6 illustrate a third embodiment of the present invention. In the third embodiment, the connecting member 2 has a first end 23 and an opposing second end 24. The main body 1 is disposed at the first end 23, and the second end 24 is provided with a brush 4. The pivot portion 21 and the bearing 22 are disposed between the main body 1 and the brush 4.

Referring to FIG. 6, the washing machine 3 generally comprises a fixed outer tank 33 and an inner tank 31 which can be driven to swing. The outer tank 33 and the inner tank 31 are spaced apart to form a space 34 therebetween. The second end 24 of the connecting member 2 passes through the perforation 32 of the inner tank 31 and extends to the space 34. The pivot 21 and the bearing 22 are mounted to the perforation 32 of the inner tank 31. The brush 4 is located in the space 34 and gets contact with the outer tank 33. The brush 4 is also rotated synchronously when the main body 1 is lashed by the water to rotate the connecting member 2. Accordingly, this embodiment can increase the cleaning effect of the outer tank 33 by the rotation of the brush 4 while the main body 1 is rotated by the impact of the water to improve the cleaning effect of clothes.

Figure 7:
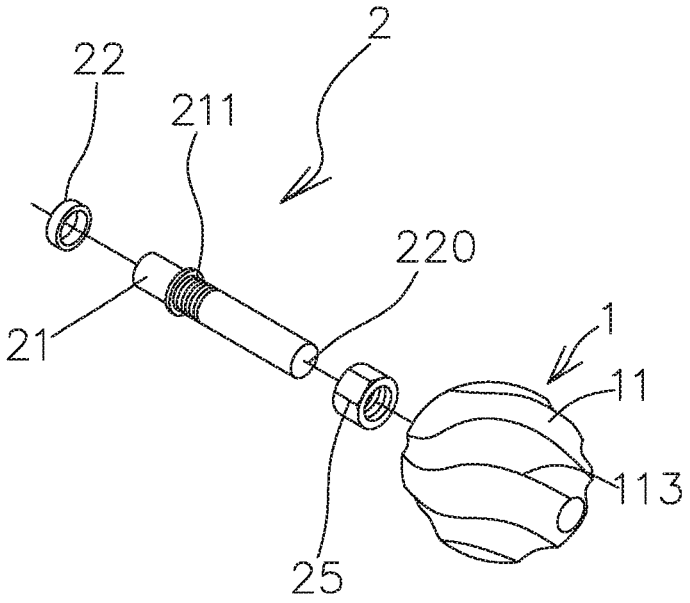
FIG. 7 is an exploded view in accordance with a fourth embodiment of the present invention.
Figure 8:
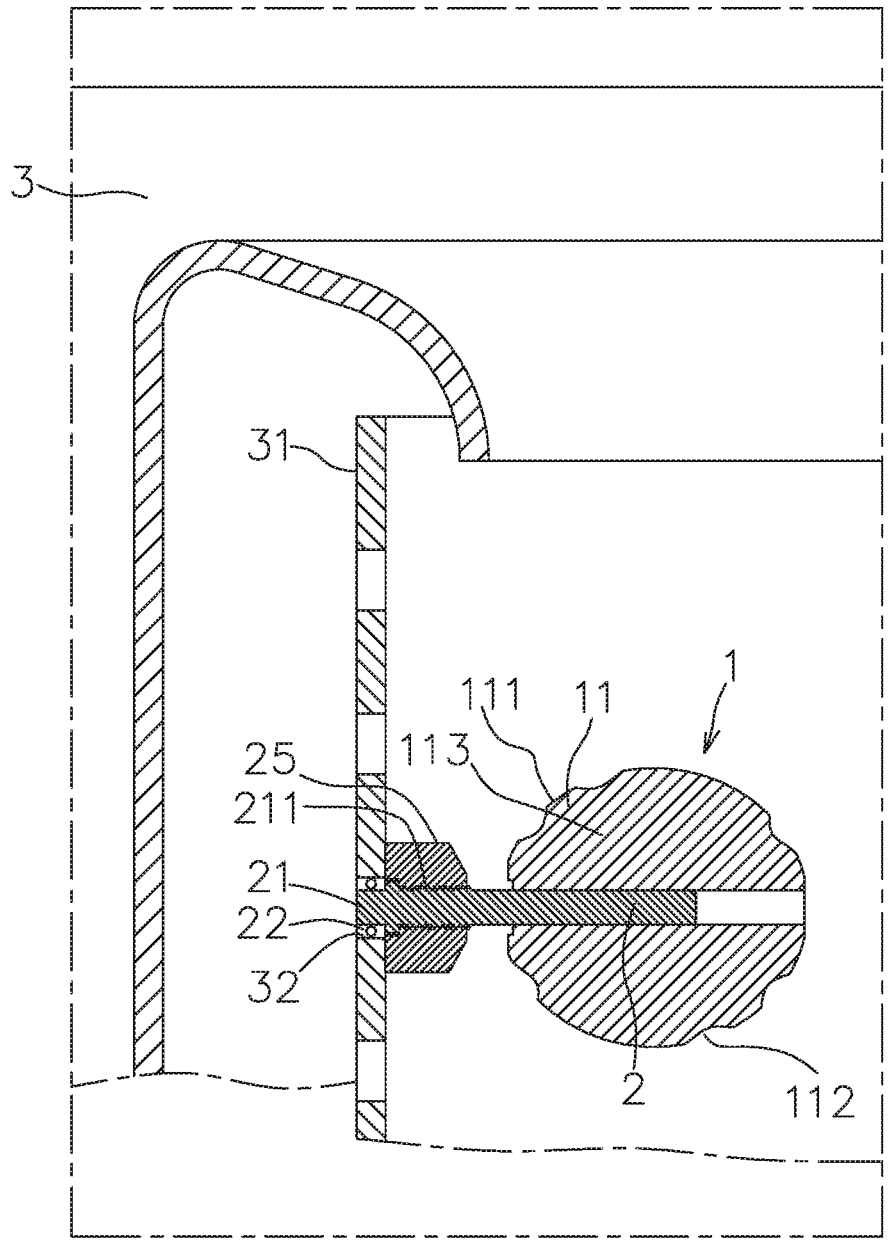
FIG. 8 is a sectional schematic view in accordance with the fourth embodiment of the present invention mounted to the inner tank of the washing machine.

FIG. 7 and FIG. 8 illustrate a fourth embodiment of the present invention. The fourth embodiment is substantially similar to the first embodiment with the exceptions described hereinafter. The connecting member 2 is provided with an auxiliary fixing segment 211 adjacent to the pivot portion 21. In this embodiment, the auxiliary fixing segment 211 is a threaded segment located in the inner tank 31. The connecting member 2 is provided with an auxiliary fixing member 25 corresponding to the auxiliary fixing segment 211. The auxiliary fixing member 25 is a hollow ring fitted on the connecting member 2 to engage with or disengage from the auxiliary fixing segment 211. (In this embodiment, the auxiliary fixing member and the auxiliary fixing segment have corresponding threads.) When in use, the auxiliary fixing member 25 is screwed to lean against the inner wall of the inner tank 31, so that the main body 1 is not easily shaken by the impact of the water to form a more stable structure.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A rotary laundry rod structure of a washing machine, comprising:

a main body disposed inside an inner tank of the washing machine, a surface of the main body being provided with a plurality of protrusions, the protrusions each having a resistant surface for resisting water inside the inner tank of the washing machine; and a connecting member, the connecting member having a pivot portion pivotally connected to the inner tank of the washing machine, the connecting member being fixedly connected to the main body, the connecting member having a first end and an opposing second end, the main body being disposed at the first end, and the second end being provided with a brush located in a space between the inner tank and an outer tank of the washing machine, wherein when the resistant surface of the main body is lashed by the water inside the inner tank, the connecting member is turned relative to the inner tank of the washing machine.

2. The rotary laundry rod structure as claimed in claim 1, wherein each of the protrusions is a spiral raised stripe.

3. The rotary laundry rod structure as claimed in claim 1, wherein each of the protrusions is a plate-like blade.

4. The rotary laundry rod structure as claimed in claim 1, wherein the connecting member is integrally formed with the main body.

5. The rotary laundry rod structure as claimed in claim 1, wherein the pivot portion includes a bearing.

6. The rotary laundry rod structure as claimed in claim 1, wherein the connecting member is provided with an auxiliary fixing segment adjacent to the pivot portion and an auxiliary fixing member corresponding to the auxiliary fixing segment, and the auxiliary fixing member is a hollow ring fitted on the connecting member to engage with or disengage from the auxiliary fixing segment.

7. The rotary laundry rod structure as claimed in claim 6, wherein the auxiliary fixing segment is located in the inner tank.

* * * * *